US008528659B2

(12) United States Patent
Nelson

(10) Patent No.: US 8,528,659 B2
(45) Date of Patent: Sep. 10, 2013

(54) PNEUMATIC POWER TOOL WITH EXHAUST SILENCER

(75) Inventor: Anders Urban Nelson, Älvsjö (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 1124 days.

(21) Appl. No.: 11/910,601

(22) PCT Filed: Apr. 3, 2006

(86) PCT No.: PCT/SE2006/000393

§ 371 (c)(1),
(2), (4) Date: Oct. 3, 2007

(87) PCT Pub. No.: WO2006/107255

PCT Pub. Date: Oct. 12, 2006

(65) Prior Publication Data

US 2008/0190635 A1 Aug. 14, 2008

(30) Foreign Application Priority Data

Apr. 5, 2005 (SE) ..... 0500737

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |

(52) U.S. Cl.
USPC ..... 173/218; 173/219

(58) Field of Classification Search
USPC ..... 173/218–219
See application file for complete search history.

(56) References Cited

U.S. PATENT DOCUMENTS

| | | | | |
|---|---|---|---|---|
| 1,354,348 | A * | 9/1920 | Smith | 91/231 |
| 1,571,560 | A * | 2/1926 | Smith et al. | 91/239 |
| 1,759,473 | A * | 5/1930 | Van Hamersveld | 173/179 |
| 1,776,604 | A * | 9/1930 | Smith, Sr. et al. | 173/65 |
| 1,871,726 | A * | 8/1932 | Nell | 173/97 |
| 1,898,494 | A * | 2/1933 | Nell | 91/239 |
| 1,913,916 | A * | 6/1933 | Carlotti | 91/239 |
| 1,929,457 | A * | 10/1933 | Tardiff | 91/239 |
| 1,995,230 | A * | 3/1935 | Suzuki | 91/297 |
| 2,252,711 | A * | 8/1941 | Gartin | 91/239 |

(Continued)

FOREIGN PATENT DOCUMENTS

| | | | |
|---|---|---|---|
| DE | 2557836 | A1 | 6/1976 |
| GB | 1367718 | A | 9/1974 |

*Primary Examiner* — Robert Long
(74) *Attorney, Agent, or Firm* — Holtz, Holtz, Goodman & Chick, PC

(57) ABSTRACT

A power tool has a housing, a pneumatic rotation motor supplied with pressure air via an inlet passage, an outlet passage connecting the motor to an exhaust air discharge, and a speed governor for controlling the pressure air flow through the inlet passage responsive to the motor speed. The outlet passage includes a first outlet duct and a second outlet duct extending in parallel between the motor and exhaust air discharge, and an exhaust valve which controls exhaust air flow through the second outlet duct. The exhaust valve is spring biased toward a closed position and shifted to an open position by an activator which is exposed to the air pressure in the inlet passage downstream of the speed governor and which shifts the exhaust valve to the open position at pressure levels above a certain pressure level in the inlet passage downstream of the speed governor.

4 Claims, 2 Drawing Sheets

(56) References Cited

U.S. PATENT DOCUMENTS

| | | | | | |
|---|---|---|---|---|---|
| 2,415,521 | A | * | 2/1947 | O'Farrell | 91/239 |
| 2,426,409 | A | * | 8/1947 | O'Farrell | 91/231 |
| 2,448,875 | A | * | 9/1948 | Fossum | 91/239 |
| 2,525,422 | A | * | 10/1950 | Nast | 74/89.23 |
| 2,643,731 | A | * | 6/1953 | Schmid | 181/230 |
| 2,738,769 | A | * | 3/1956 | Holman et al. | 173/133 |
| 2,743,707 | A | * | 5/1956 | Kellersman | 30/228 |
| 2,830,560 | A | * | 4/1958 | Doeden | 173/59 |
| 3,068,973 | A | * | 12/1962 | Maurer | 173/93.6 |
| 3,253,662 | A | * | 5/1966 | Sacchini | 173/177 |
| 3,270,834 | A | * | 9/1966 | Bratt | 181/230 |
| 3,554,316 | A | * | 1/1971 | Judd et al. | 181/230 |
| 3,602,315 | A | * | 8/1971 | Tuttle | 173/1 |
| 3,635,299 | A | * | 1/1972 | Hayes | 181/230 |
| 3,753,469 | A | * | 8/1973 | Tuttle | 173/218 |
| 3,809,179 | A | * | 5/1974 | Delaney et al. | 181/230 |
| 3,934,657 | A | * | 1/1976 | Danielson | 173/169 |
| 3,993,159 | A | * | 11/1976 | Amador | 181/230 |
| 4,018,291 | A | | 4/1977 | Anderson | |
| 4,057,113 | A | * | 11/1977 | Paule et al. | 173/179 |
| 4,135,602 | A | * | 1/1979 | Clark | 181/230 |
| 4,161,996 | A | * | 7/1979 | Dolejsi | 181/230 |
| 4,189,917 | A | * | 2/1980 | Gunning | 60/370 |
| 4,243,110 | A | * | 1/1981 | Clemenson et al. | 173/104 |
| 4,404,799 | A | * | 9/1983 | Dudek | 60/370 |
| 4,665,703 | A | * | 5/1987 | David | 60/595 |
| 4,838,234 | A | * | 6/1989 | Mayer | 123/559.2 |
| 4,844,177 | A | * | 7/1989 | Robinson et al. | 173/178 |
| 4,962,787 | A | * | 10/1990 | Mayhew | 137/556.3 |
| 5,383,771 | A | * | 1/1995 | Ghode et al. | 418/15 |
| 5,441,445 | A | * | 8/1995 | Karubian et al. | 452/133 |
| 5,581,055 | A | * | 12/1996 | Self et al. | 181/230 |
| 5,591,070 | A | * | 1/1997 | Kachich | 451/295 |
| 5,901,794 | A | * | 5/1999 | Schoeps et al. | 173/93.5 |
| 5,927,584 | A | * | 7/1999 | Akiba | 227/130 |
| 5,992,539 | A | * | 11/1999 | Lin | 173/93 |
| 6,062,323 | A | * | 5/2000 | Pusateri et al. | 173/169 |
| 6,135,213 | A | * | 10/2000 | Schoeps | 173/93.5 |
| 6,158,528 | A | * | 12/2000 | Izumisawa | 173/168 |
| 6,530,436 | B2 | * | 3/2003 | Nowak et al. | 173/168 |
| 6,695,072 | B2 | * | 2/2004 | Izumisawa | 173/168 |
| 7,185,712 | B2 | * | 3/2007 | Miller et al. | 173/1 |
| 7,311,155 | B2 | * | 12/2007 | Chang et al. | 173/104 |
| 7,398,836 | B2 | * | 7/2008 | Elmvist et al. | 173/218 |
| 7,527,106 | B2 | * | 5/2009 | Miller et al. | 173/1 |
| 7,537,027 | B2 | * | 5/2009 | Bass et al. | 137/625.5 |
| 2003/0121680 | A1 | * | 7/2003 | Izumisawa et al. | 173/93.5 |
| 2004/0144553 | A1 | * | 7/2004 | Ashbaugh | 173/169 |
| 2006/0278416 | A1 | * | 12/2006 | Tanji | 173/90 |

* cited by examiner

PNEUMATIC POWER TOOL WITH EXHAUST SILENCER

This application is a U.S. National Phase Application under 35 USC 371 of International Application PCT/SE2006/00393 filed Apr. 3, 2006.

FIELD OF THE INVENTION

This invention relates to a pneumatic power tool having a housing and a pressure air driven rotation motor which is connected to a pressure air inlet passage and via an exhaust air outlet passage to an outlet opening means in the housing, and a speed governor connected to the motor and having a valve element arranged to control the air flow through the inlet passage.

BACKGROUND OF THE INVENTION

A problem concerned with power tools of this type is the considerable exhaust noise from the motor. This is particularly annoying at idle running when no process noise is created. For instance in pneumatic grinders the process noise created during grinding is very loud and dominates completely over the exhaust noise from the motor, which means that even during operation when the motor is delivering full power the exhaust noise from the motor is no problem. When, however, the motor is relieved from load the speed governor will automatically start choking the pressure air inlet flow so as to bring down the power output of the motor and hence limit the idle speed of the motor. Still there is a considerable noise emanating from the motor exhaust, and since there is no process noise present the motor exhaust noise will be dominant and cause an annoying noise level at the working site.

SUMMARY OF THE INVENTION

It is an object of the invention to create a pneumatic power tool wherein the exhaust noise from the motor at idle running is considerably reduced without having a negative influence on the full power output of the tool.

Further objects and advantages of the invention will appear from the following specification and claims.

According to an aspect of the invention, a power tool includes a housing, a pneumatic rotation motor, an air inlet passage for ducting motive pressure air to the motor, an exhaust air outlet passage connecting the motor to an exhaust air discharging means in the housing, and a speed governor connected to the motor and arranged to control the air flow through the inlet passage. The outlet passage includes a first outlet duct and a second outlet duct extending in parallel with each other between the motor and the exhaust air discharging means. The first outlet duct continuously connects the motor to the exhaust air discharging means. An exhaust valve is arranged to control the air flow through the second outlet duct by being shiftable between a closed position and an open position. The exhaust valve is spring biased towards the closed position. And an activation means is arranged to shift the exhaust valve from the closed position to the open position at air pressure levels above a certain pressure level in the air inlet passage downstream of the speed governor.

A preferred embodiment of the invention is described in detail below with reference to the accompanying drawings.

DETAILED DESCRIPTION

Figure 1:
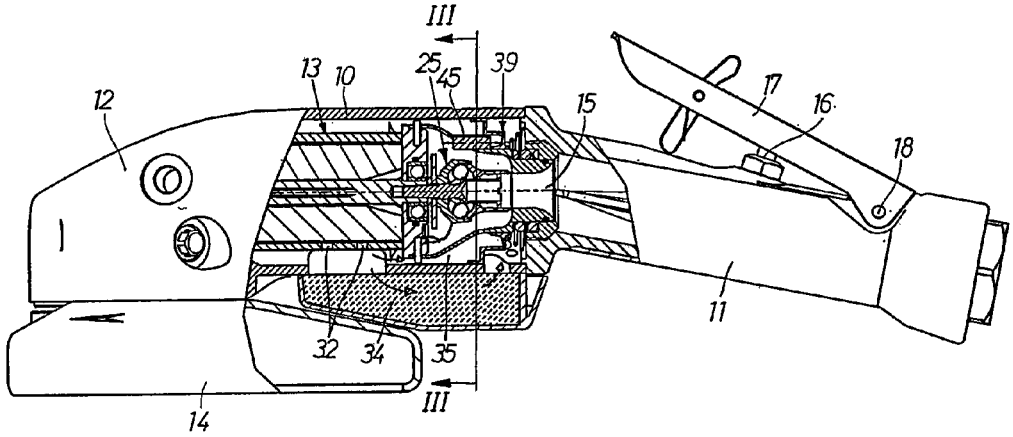
FIG. 1 shows a longitudinal section through a power tool according to the invention.

The power tool shown in the drawings is a pneumatic angle grinder having a housing 10 with a handle 11 at its rear end and an angle drive 12 with an output shaft (not illustrated) at its forward end. The output shaft is intended to carry a grinding wheel, and a protective wheel guard 14 is secured to the front part of the housing 10. In the housing 10 there is supported a pressure air driven rotation motor 13 which is drivingly connected to the output shaft via the angle drive 12 and which via a pressure air inlet passage 15 and a throttle valve 16 is supplied with motive pressure air. The throttle valve 16 is operable by a maneuver lever 17 which is pivotally supported on the handle 11 via a hinge 18.

The motor 13 comprises a cylinder 21 and a rotor 22 which is journalled in bearings mounted in two opposite end walls and which is connected to a speed governor 25 for controlling the air supply to the motor 13 in response to the actual motor speed. Only the rear end wall 23 of the motor 13 is visible in the drawings. The speed governor 25 comprises a tubular valve element 26 which is arranged to be displaced by centrifugal force activated balls 27 into an air inlet flow restricting position to thereby limit the idle speed of the motor to a predetermined level. In its flow restricting position the valve element 26 co-operates with an annular seat 28 formed by a shoulder in the air inlet passage 15. This shoulder is formed by a neck portion 29 on a bell-shaped insert 30 secured to the motor end wall 23 by dowels 31.

The motor 13 has one or more air inlet ports (not illustrated) in the rear end wall 23 communicating with the air inlet passage 15, and a number of exhaust ports 32 in the cylinder 21. The exhaust ports 32 communicate with exhaust outlet openings 33 in the housing 10 via a first outlet duct 34, a second outlet duct 35 and an exhaust chamber 36. The exhaust chamber 36 and the outlet openings 33 form an exhaust discharging means, and the first and second outlet ducts 34,35 extend in parallel with each other from the exhaust ports 32 of the motor 13 to the exhaust chamber 36. The first outlet duct 34 is located at one side of the housing 10, whereas the second outlet duct 35 is annular in shape and surrounds the motor 13. The first outlet duct 34 contains a filling 38 of a porous sound damping material.

At the downstream end of the second outlet duct 35 there is provided an exhaust valve 39 which comprises an annular valve element 40 movably guided on the insert 30, a valve seat 41 formed on a wall element 42 (see FIG. 2A) in the housing 10, and a spring 44 is arranged to bias the valve element 40 towards the seat 41. As the valve element 40 co-operates with the seat 41 the second exhaust duct 35 is closed. The first exhaust duct 34, though, is always open to communicate with exhaust chamber 36.

Figure 3:
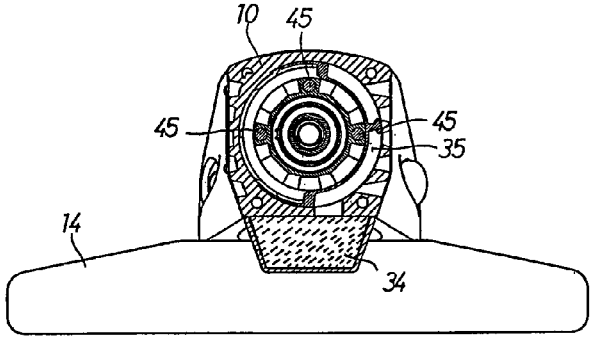
FIG. 3 shows a cross section along line III-III in FIG. 1.

The exhaust valve 39 further comprises an activation means in the form of a number of piston elements 45 movably guided in the insert 30. At their one ends the piston elements 45 contact the valve element 40, and by their opposite ends the piston-elements 45 extend into the inlet passage 15 at a point downstream of the speed governor valve element 26 to, thereby, be exposed to the air pressure in the inlet passage 15 at that point. The total end surface area of the piston elements 45 and the bias force of the spring 44 are chosen so as to maintain the valve element 40 in closed position as long as the pressure in the inlet passage 15 is low due to a closed or almost closed speed governor valve element 26 at idle speed condition of the motor. In other words, when the tool is relieved from a working load and the motor speed increases the speed governor 25 gets into action which means that the valve element 26 is urged by the balls 27 into co-operation with the seat 28 to restrict the pressure air inlet flow and limit the idle speed of the motor 13. Thereby, the pressure downstream of the speed governor valve element 26 is reduced, which means that the force acting on the end surfaces of the piston elements 45 is reduced and will not be able to maintain the valve element 40 in the open position against the action of the spring 44. Thereby, the valve element 40 is displaced by the spring 44 to its closed position in contact with the seat 41. See FIG. 3B.

Accordingly, in the idle running condition of the tool the exhaust valve element 40 occupies its closed position which means that the second outlet duct 35 is blocked and the exhaust air flow from the motor 13 can only reach the exhaust chamber 36 via the first outlet duct 34. The exhaust flow through the first outlet duct 34 is restricted and damped by means of the filling 38 and will not create any annoying noise when finally leaving the tool housing 10.

Figure 2A:
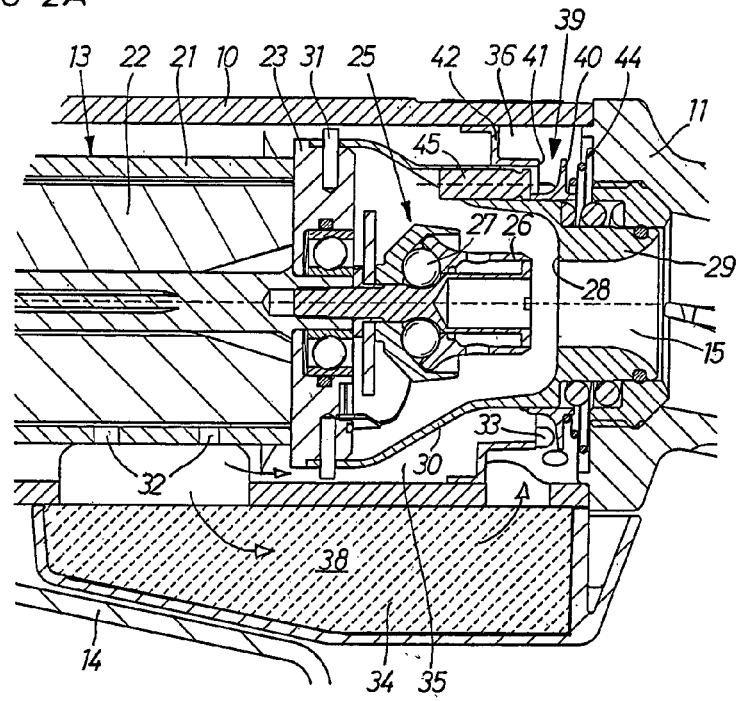
FIG. 2A shows, on a larger scale, a fractional section of the power tool in FIG. 1 illustrating a full power condition of the tool.
Figure 2B:
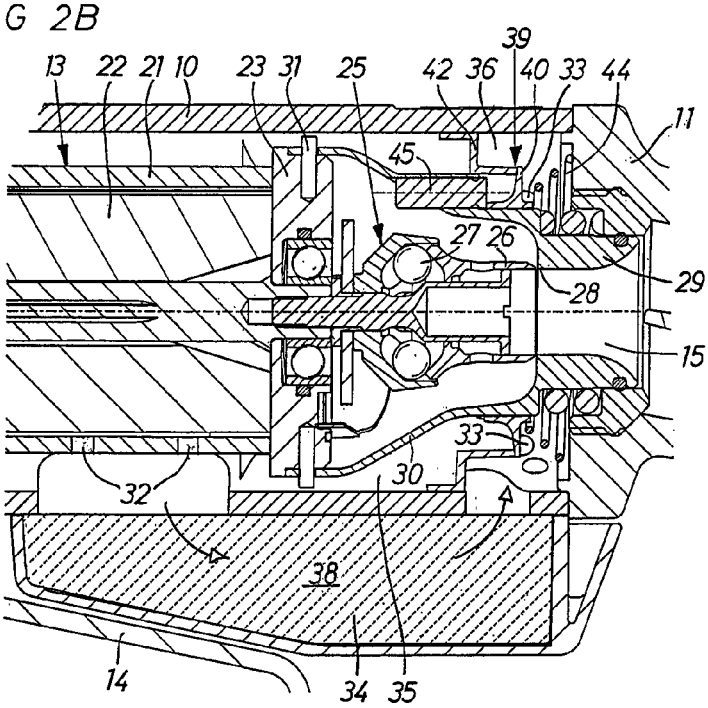
FIG. 2B shows a section similar to FIG. 2A, but illustrating the tool in an idle running condition.

In the condition illustrated in FIG. 2A the power tool is working at full power output as a working load is applied on the output shaft. In this condition the motor speed is brought down below the predetermined level where the speed governor 25 is set to restrict the pressure air inlet flow. This means that the speed governor valve element 26 is in its rest position at a distance from the seat 28, thereby leaving a full flow opening past the governor 25. This also means that the air pressure downstream of the speed governor valve element 26 is high, thereby exerting a high enough pressure load on the piston elements 45 to make them move the exhaust valve element 40 to open position against the action of the spring 44.

In this full power working condition of the tool both the first outlet duct 34 and the second outlet duct 35 are open to permit an unrestricted exhaust flow from the motor 13. In this condition the exhaust air flow through the outlet openings 33 in the housing 10 will be rather noisy, but the noise of the ongoing working process is far higher and will dominate completely over the exhaust noise.

Accordingly, the invention suggests a pneumatic power tool which by a two-way exhaust passage, namely one constantly open and noise damped duct for idle running and another valve controlled duct open at full power operation only, provides a low noise idle running without having any power restricting effect at full power operation.

It is to be noted though that the embodiments of the invention are not limited to the above described example but can be freely varied within the scope of the claims. For instance, the activation means for the exhaust valve may be designed differently, i.e. the separate piston elements may be exchanged by a single annular piston.

The invention claimed is:

1. A pneumatic power tool comprising:

a housing;

a pneumatic rotation motor;

an air inlet passage for ducting motive pressure air to the motor;

a motor speed responsive speed governor located in the air inlet passage and arranged to operate between an air inlet flow restricting position and a full flow position, thereby controlling air pressure in the air inlet passage downstream of the speed governor;

an exhaust air discharging means;

a first exhaust air outlet duct which continuously connects the motor to the exhaust air discharging means;

a sound damping flow restriction provided in the first exhaust air outlet duct;

a second exhaust air outlet duct which connects the motor to the exhaust air discharging means;

an exhaust valve which is located in the second exhaust air outlet duct and is shiftable between a closed position and an open position, wherein the exhaust valve is not located in the first exhaust air outlet duct;

a spring arranged to bias the exhaust valve toward the closed position; and a pressure-operated activation means connected to the exhaust valve and arranged to be exposed to the pressure in the air inlet passage downstream of the speed governor, wherein the activation means is arranged to automatically shift the exhaust valve from the closed position to the open position against the action of the spring at pressure levels above a certain level in the air inlet passage downstream of the speed governor;

wherein the first exhaust air outlet duct continuously connects the motor to the exhaust air discharging means and the exhaust valve is located in the second exhaust air outlet duct but not in the first exhaust air outlet duct, such that when the exhaust valve is in the closed position the first exhaust air outlet duct continues to connect the motor to the exhaust air discharging means so that exhaust air from the motor can reach the exhaust air discharging means via the first exhaust air outlet duct when the exhaust valve is in the closed position; and wherein the exhaust valve comprises an annular valve body disposed in a coaxial relationship with the air inlet passage.

2. The power tool according to claim 1, wherein the sound damping flow restriction provided in the first exhaust air outlet duct comprises a porous sound damping material.

3. The power tool according to claim 2, wherein the activation means comprises at least two piston elements having respective first ends abutting against the annular valve body and respective second ends, which are opposite to the first ends, exposed to the pressure in the air inlet passage downstream of the speed governor.

4. The power tool according to claim 1, wherein the activation means comprises at least two piston elements having respective first ends abutting against the annular valve body and respective second ends, which are opposite to the first ends, exposed to the pressure in the air inlet passage downstream of the speed governor.

* * * * *